US007228986B2

(12) United States Patent
Hayes et al.

(10) Patent No.: US 7,228,986 B2
(45) Date of Patent: Jun. 12, 2007

(54) BASE FOR FOOD CONTAINERS

(75) Inventors: Thomas J. Hayes, McHenry, IL (US); James N. Gomoll, Lindenhurst, IL (US)

(73) Assignee: Pactiv Corporation, Lake Forest, IL (US)

( * ) Notice: Subject to any disclaimer, the term of this patent is extended or adjusted under 35 U.S.C. 154(b) by 514 days.

(21) Appl. No.: 10/620,650

(22) Filed: Jul. 16, 2003

(65) Prior Publication Data

US 2004/0016762 A1 Jan. 29, 2004

Related U.S. Application Data

(63) Continuation of application No. 09/910,515, filed on Jul. 19, 2001, now Pat. No. 6,619,501.

(51) Int. Cl.
*B65D 6/38* (2006.01)

(52) U.S. Cl. ..... 220/675

(58) Field of Classification Search ..... None
See application file for complete search history.

(56) References Cited

U.S. PATENT DOCUMENTS

| | | | | |
|---|---|---|---|---|
| 2,061,610 | A | 11/1936 | Burnette | 53/7 |
| D177,360 | S | 4/1956 | Becker et al. | D44/1 |
| D195,699 | S | 7/1963 | Bostrom | D58/11 |
| 3,098,597 | A | 7/1963 | Johnson et al. | 229/2.5 |
| 3,104,776 | A | 9/1963 | Bostrom | 220/73 |
| D197,310 | S | 1/1964 | Butzko | D58/11 |
| D198,290 | S | 5/1964 | Miller, Jr. et al. | D58/12.6 |
| D198,545 | S | 6/1964 | Bostrom | D58/13 |
| 3,151,799 | A | 10/1964 | Engles, Jr. et al. | 229/2.5 |
| 3,253,762 | A | 5/1966 | Gaunt | 229/2.5 |
| 3,318,283 | A | 5/1967 | Maclam et al. | 118/500 |
| D209,605 | S | 12/1967 | Zoeller et al. | D44/1 |
| 3,563,445 | A | 2/1971 | Clayton | 229/25 |
| D226,775 | S | 4/1973 | Jones | D7/2 |
| D249,234 | S | 9/1978 | Limon et al. | D9/219 |
| D249,238 | S | 9/1978 | Limon et al. | D9/219 |
| 4,127,189 | A | 11/1978 | Shumrak et al. | 206/520 |
| D255,659 | S | 7/1980 | Dugan et al. | D9/219 |
| D270,703 | S | 9/1983 | El-Hag et al. | D7/357 |
| D273,181 | S | 3/1984 | Braddon | D9/425 |
| 4,442,969 | A | 4/1984 | Holden | 229/2.5 |

(Continued)

FOREIGN PATENT DOCUMENTS

BE 572074 11/1958

(Continued)

OTHER PUBLICATIONS

English Abstract of European Patent No. EP51868, which is related to German Patent No. 8029894.

(Continued)

*Primary Examiner*—Stephen J. Castellano
(74) *Attorney, Agent, or Firm*—Baker Botts L.L.P.

(57) ABSTRACT

A base for a food container includes a pattern of rib units in a side wall of the container. The rib units are formed at multiple angles and depths to provide strength to the side wall. The base also includes a bottom with ribs of alternating heights and angles that provide strength to the bottom.

24 Claims, 8 Drawing Sheets

U.S. PATENT DOCUMENTS

| | | | | |
|---|---|---|---|---|
| 4,466,552 | A | 8/1984 | Butterworth et al. | 220/354 |
| D276,216 | S | 11/1984 | Michaud | D9/425 |
| D280,182 | S | 8/1985 | Tyler | D9/425 |
| 4,533,585 | A | 8/1985 | Holden | 428/116 |
| D290,232 | S | 6/1987 | Holzkopf et al. | D9/424 |
| D298,791 | S | 12/1988 | Holzkopf | D7/83 |
| 4,863,058 | A | 9/1989 | Antoni et al. | 220/72 |
| 4,874,083 | A | 10/1989 | Antoni et al. | 206/45 |
| D304,909 | S | 12/1989 | Natori | D9/423 |
| D305,409 | S | 1/1990 | Michaud et al. | D9/425 |
| 4,994,638 | A | 2/1991 | Iorns et al. | 219/10.55 |
| 5,046,659 | A | 9/1991 | Warburton | 229/2.5 |
| 5,094,355 | A | 3/1992 | Clark et al. | 220/4.23 |
| 5,131,551 | A | 7/1992 | Wells | 220/4.23 |
| D341,316 | S | 11/1993 | Fritz et al. | D9/429 |
| 5,269,430 | A | 12/1993 | Schlaupitz et al. | 220/4.23 |
| D343,576 | S | 1/1994 | Krupa | D9/423 |
| D345,894 | S | 4/1994 | Krupa | D7/552 |
| D345,912 | S | 4/1994 | Krupa | D9/429 |
| 5,322,182 | A | 6/1994 | Fritz | 220/623 |
| D348,608 | S | 7/1994 | Wyslotsky | D9/425 |
| D351,999 | S | 11/1994 | Krupa | D9/423 |
| D352,000 | S | 11/1994 | Hansen et al. | D9/429 |
| 5,381,901 | A | 1/1995 | Hundley | 206/457 |
| D358,091 | S | 5/1995 | Warburton | D9/429 |
| 5,423,453 | A | 6/1995 | Fritz | 220/608 |
| 5,441,166 | A * | 8/1995 | Lucas et al. | 220/782 |
| 5,456,379 | A | 10/1995 | Krupa et al. | 220/339 |
| 5,515,993 | A | 5/1996 | McManus | 220/339 |
| 5,577,627 | A | 11/1996 | Richie-Dubler | 220/4.23 |
| 5,607,709 | A | 3/1997 | Fritz et al. | 426/106 |
| 5,628,427 | A | 5/1997 | Hayes | 220/669 |
| D382,796 | S | 8/1997 | Mangola | D9/429 |
| 5,662,237 | A | 9/1997 | Cain | 220/368 |
| 5,685,453 | A | 11/1997 | Goins et al. | 220/782 |
| D391,850 | S | 3/1998 | Krupa et al. | D9/429 |
| D392,881 | S | 3/1998 | Bulcher et al. | D9/425 |
| D392,884 | S | 3/1998 | Hayes | D9/431 |
| 5,730,313 | A | 3/1998 | Hayes et al. | 220/526 |
| D393,204 | S | 4/1998 | Goins et al. | D9/425 |
| D415,025 | S | 10/1999 | McCann | D9/429 |
| D429,961 | S | 8/2000 | Harris | D7/540 |
| D458,538 | S | 6/2002 | Hayes et al. | D9/434 |
| D461,123 | S | 8/2002 | Hayes et al. | D9/429 |
| 2003/0015539 | A1 | 1/2003 | Hayes et al. | |

FOREIGN PATENT DOCUMENTS

| | | |
|---|---|---|
| DE | 8029894 | 5/1982 |
| JP | 05132059 | 5/1993 |
| NL | 1012752 | 12/2000 |

OTHER PUBLICATIONS

International Search Report for International Application No. PCT/US02/22882; dated Nov. 6, 2002; 7 pages.

Pactiv Advanced Packaging Solutions Catering Products Catalog.

Pactiv Advanced Packaging Solutions Catering Products Catalog; Nov. 2000; 12 pgs.

Pactiv Advanced Packaging Solutions, Specialty Product Specification Catalog; 2001; 180 pgs.

Pages 67 and 81 from Specialty Products Product Specification Catalog 2001.

Tenneco Packaging Caterware Egg Insert.

Tenneco Packaging Caterware Egg Insert product brochure; Jun. 1999; 2 pgs.

Translation of Japanese Patent Abstract No. 05132059.

Translation of Netherlands Patent Abstract No. 1012752.

Pactiv, Specialty Products, Product Specification Catalog, (2001), 90 pages.

* cited by examiner

BASE FOR FOOD CONTAINERS

This application is a continuation of Ser. No. 09/910,515 filed Jul. 19, 2001, now U.S. Pat. No. 6,619,501.

FIELD OF THE INVENTION

The present invention relates to food containers and, more particularly, to an array of ribs of multiple depths and angles in the side wall and bottom of a rigid plastic food container to reinforce the food container.

BACKGROUND OF THE INVENTION

A container often used with hot foods such as roasted or broiled whole chicken has a lid and base thermoformed from plastic material. When this container is heated by the cooked food, and/or Hot case, the plastic of the container base can get soft and bend along a transverse line in reaction to the weight of the chicken when the base is grasped at one end and lifted. Ribs are formed in the base to reinforce the base but the rib patterns alone do not provide sufficient reinforcement and a thicker material for the base is often required. This increases the cost of the container. It is desirable to provide a rib array or pattern for the base of these containers that provides sufficient reinforcement to allow a thinner material to be used in thermoforming the base.

SUMMARY OF THE INVENTION

The present invention provides a pattern or array of ribs in a side wall and bottom of a thermoformed plastic container base that resists bending of the base when it is warm or cold and filled with food. The pattern includes a plurality of rib units formed in the side wall. The rib units provide multiple depths and multiple angles such that there is no straight path for bending.

In addition, a plurality of ribs are formed in the bottom of the base. The ribs are of different heights and angles relative to each other and the different heights and angles are alternated. This array or pattern prevents the formation of a straight bend line through the bottom of the base reducing the likelihood of bending under a load. This array includes longitudinal ribs extending the length of the bottom to create a beam that inhibits bending of the bottom when the base is picked up at an end of the base.

BRIEF DESCRIPTION OF THE DRAWINGS

Other objects and advantages of the invention will become apparent upon reading the following detailed description in conjunction with the drawings in which.

Figure 1:
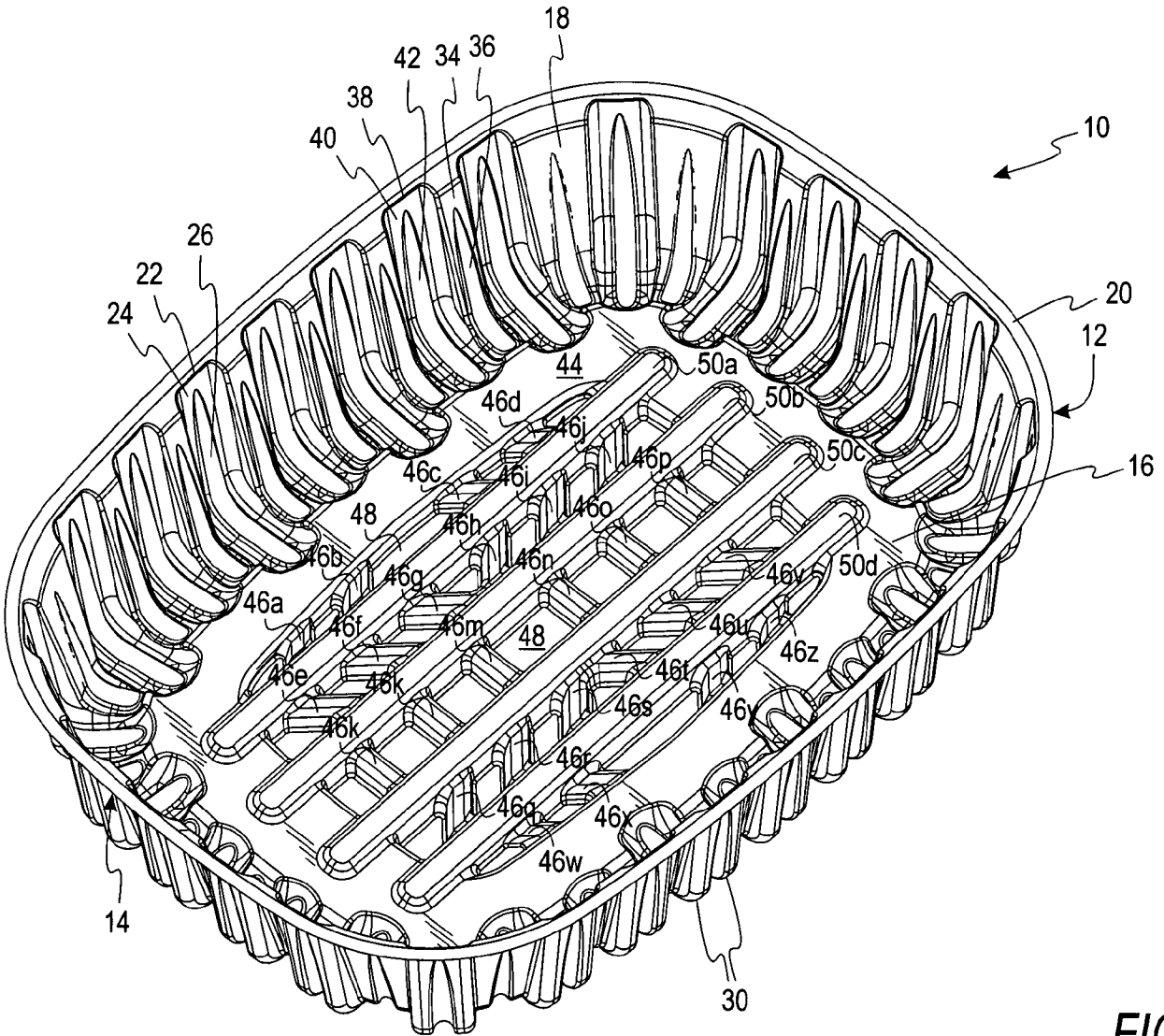
FIG. 1 is a perspective view of a base for food containers constructed in accordance with the principles of the present invention.
Figure 2:
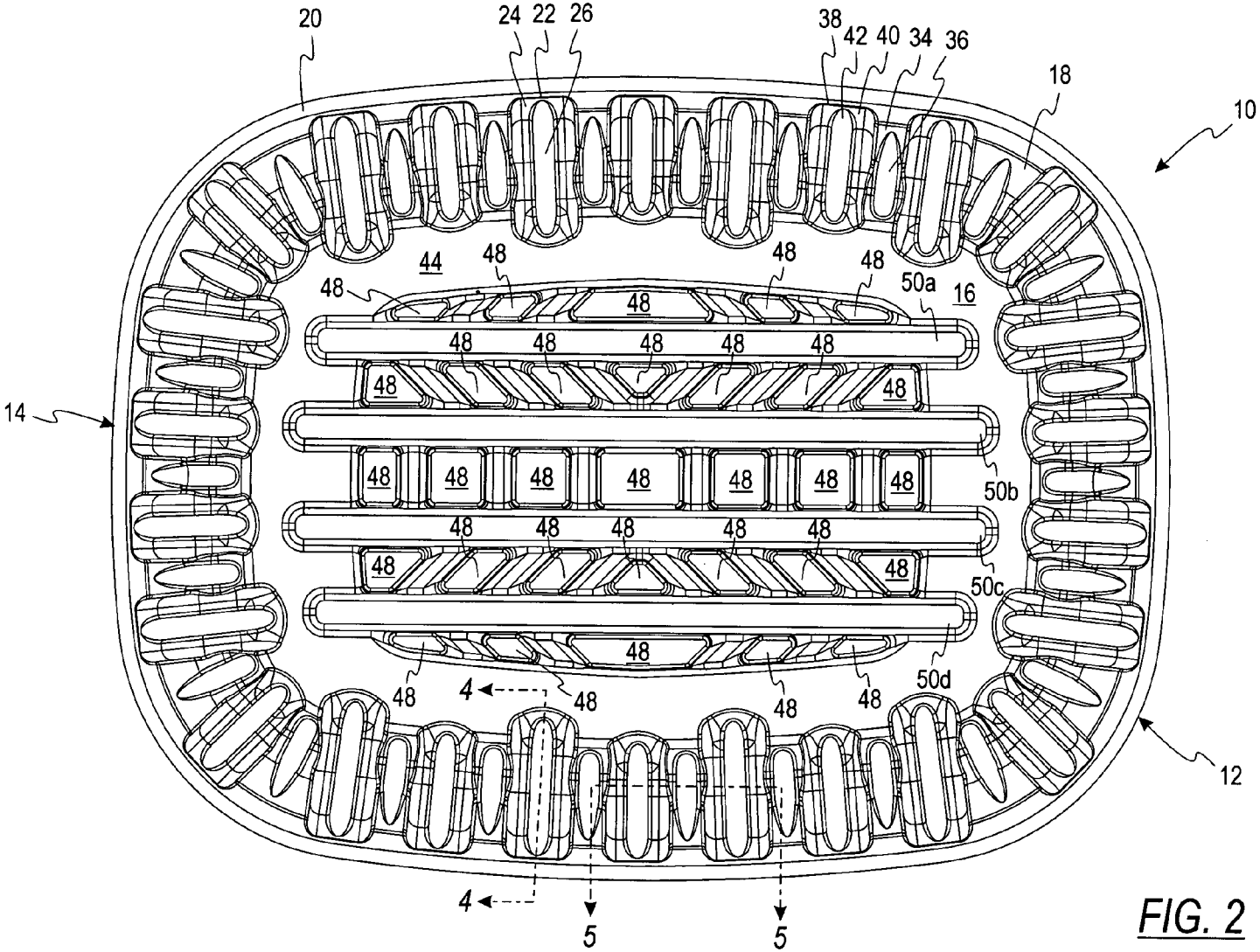
FIG. 2 is a top plan view of the base of the present invention.
Figure 3:
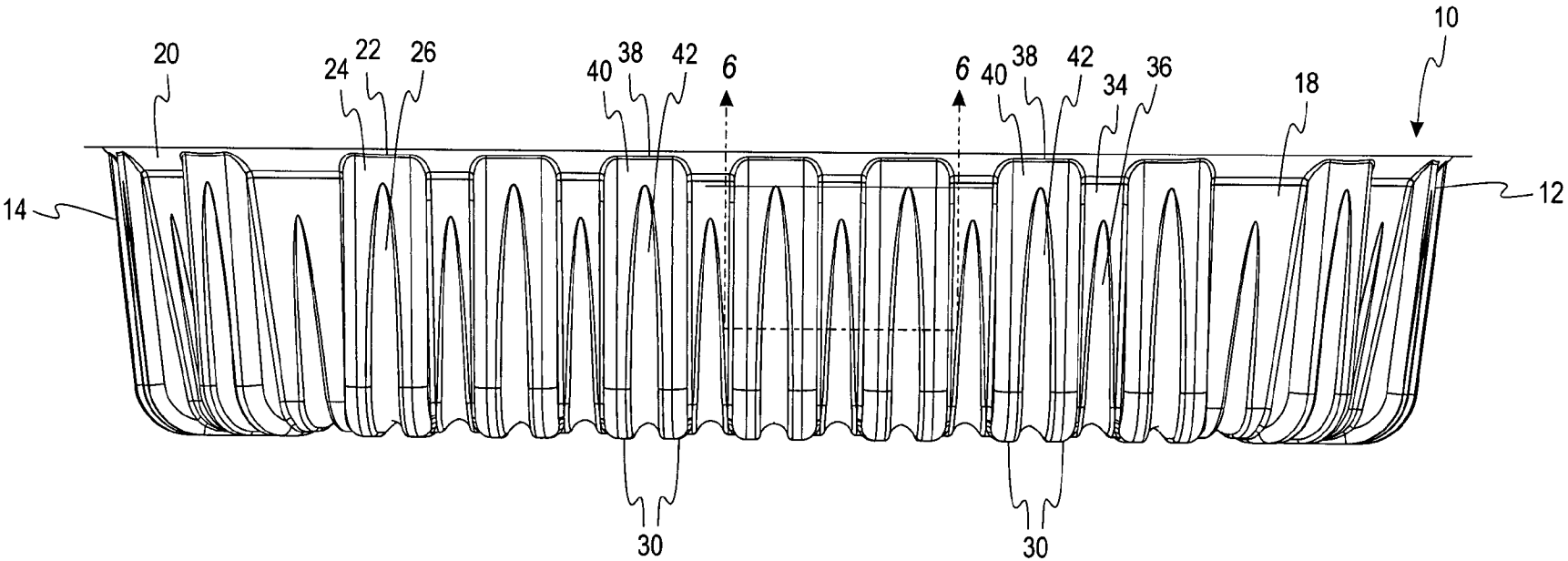
FIG. 3 is a side elevational view of the base of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE PREFERRED EMBODIMENTS

Referring initially to FIGS. 1–6, there is illustrated a base 10 for a food container. The base 10 includes a bottom 16 and a side wall 18 that extends around the entire periphery of the bottom 16 and extends from the bottom 16 to a rim 20. The base 10 can be thermoformed plastic and can be covered with a lid if desired. The base 10 is intended to carry foods and preferably hot food such as rotisserie chicken. The elevated temperature of the food and/or Hot case will heat and soften the plastic making the base 10 more prone to bending when lifted or carried by gripping a first end 12 or a second end 14 or the corners of the base 10. Since this bending is undesirable because food and/or juices can be spilled, the base 10 is strengthened to avoid bending by including a pattern or array of ribs and rib units of multiple angles and multiple depths such that the base 10 does not have a straight path of bending.

The side wall 18 includes an array or pattern of one or more rib units that provide multiple angles and depths to the side wall 18. A first rib unit 22 is thermoformed into the side wall 18 and includes a first female rib 24 and a first male rib 26 formed in the female rib 24. The first female rib 24 extends from adjacent the rim 20 into the bottom 16. The first male rib 26 is shorter than the first female rib 24 and extends from near the rim 20 into the bottom 16.

The first rib unit 22 strengthens the side wall 18 against bending by providing multiple depths. The rounded surfaces or knuckles 30 (FIG. 3) formed between the first male rib 26 and first female rib 24 results from the different widths of the first male rib 26 and the first female rib 24. The knuckles 30 also strengthen base 10 against vertical or crushing forces.

Figure 4:
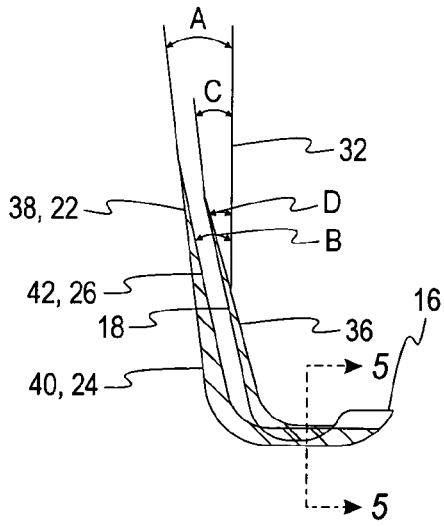
FIG. 4 is a view taken along line 4—4 in FIG. 2.
Figure 5:
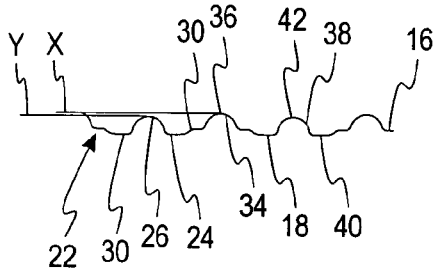
FIG. 5 is a view taken along line 5—5 in FIGS. 2 and 4.
Figure 6:
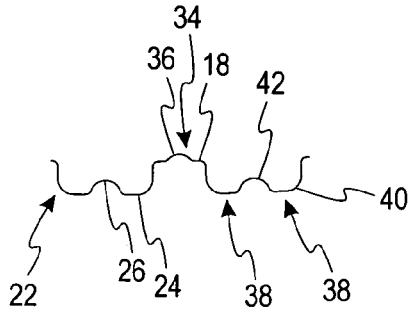
FIG. 6 is a view taken along line 6—6 in FIG. 3.
Figure 7:
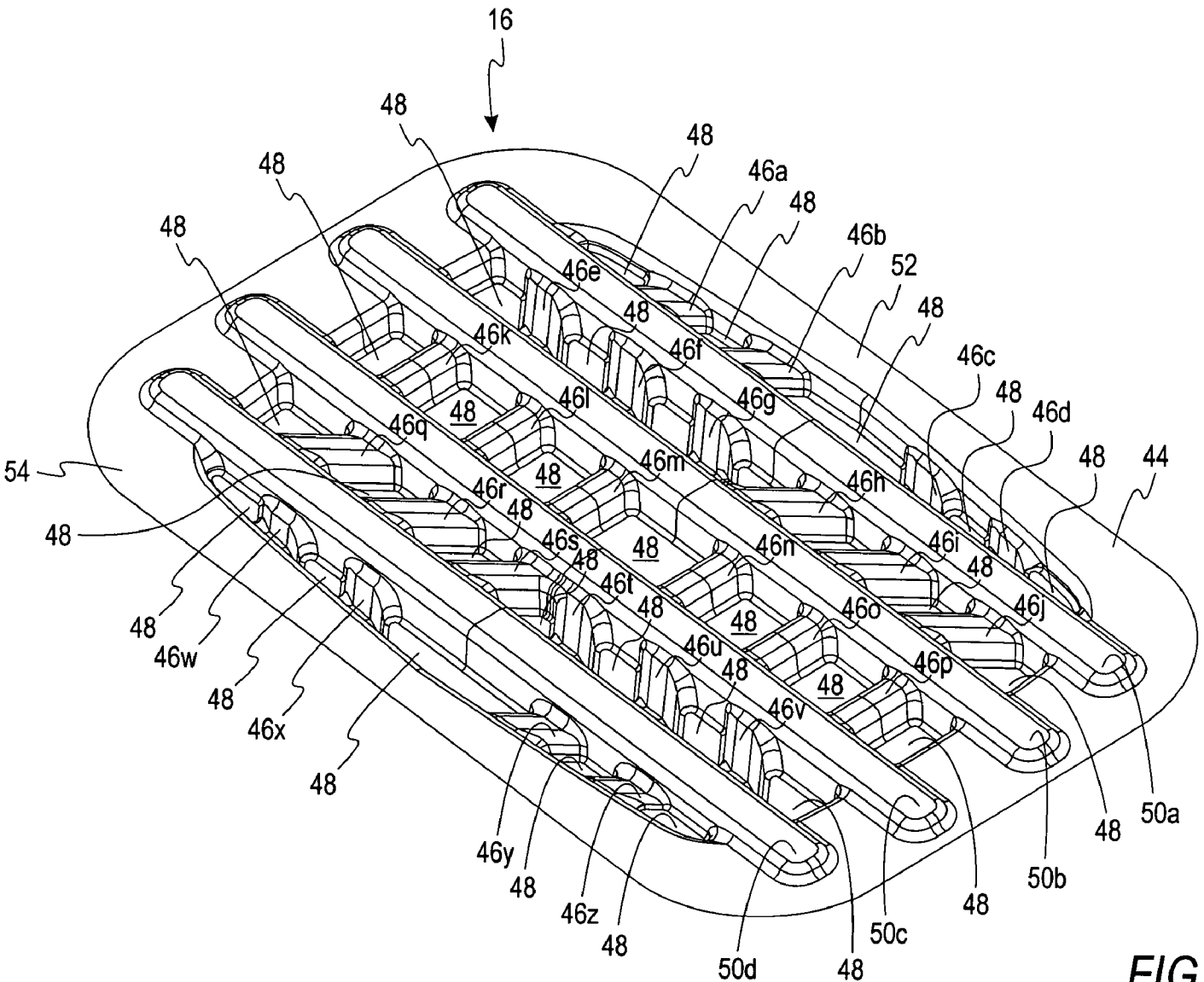
FIG. 7 is a perspective view of the bottom of the base of the present invention.
Figure 8:
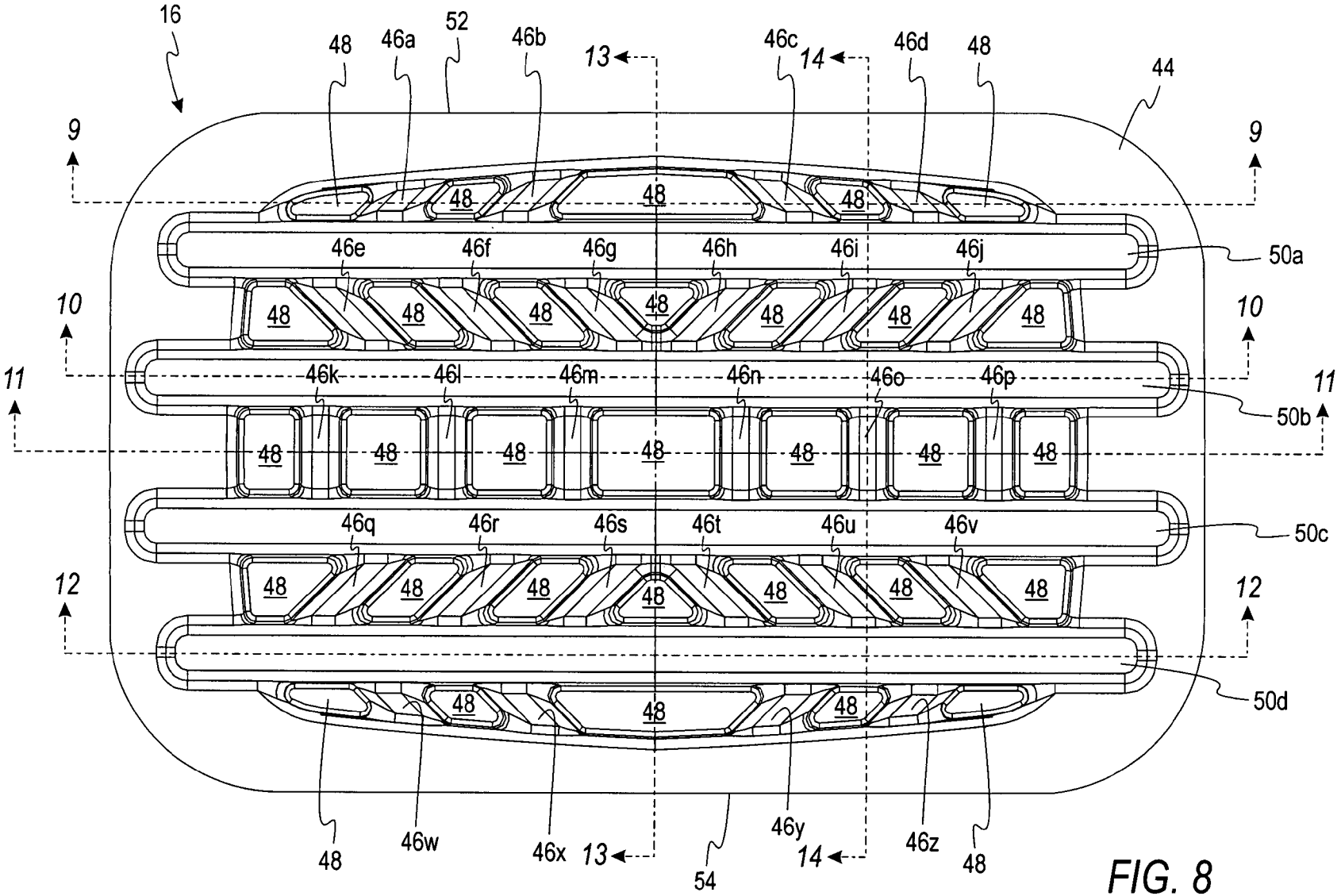
FIG. 8 is a top plan view of the bottom.
Figure 9:
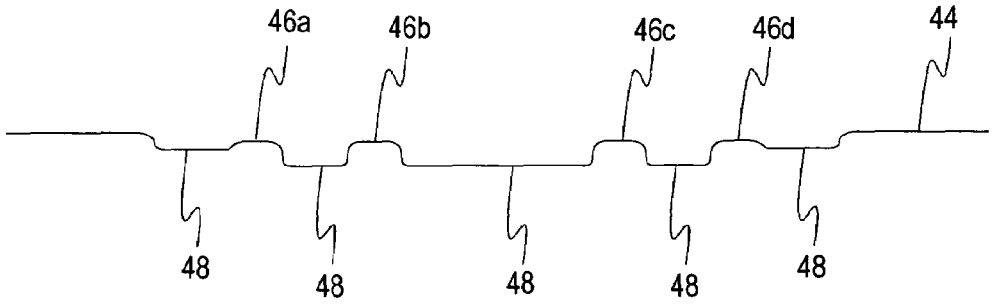
FIG. 9 is a view taken along line 9—9 of FIG. 8.
Figure 10:
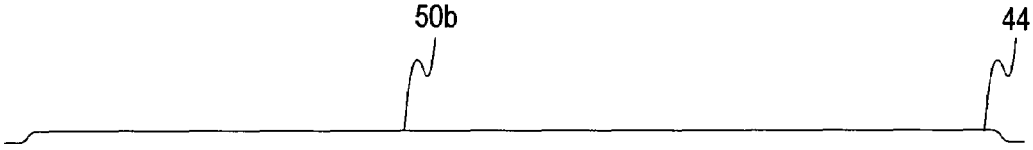
FIG. 10 is a view taken along line 10—10 of FIG. 8.
Figure 11:
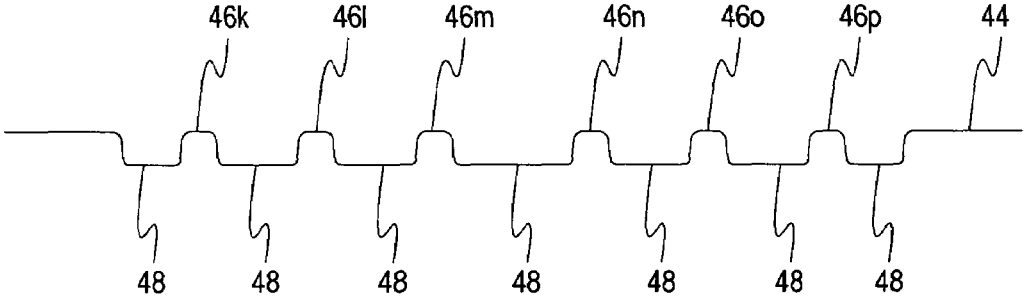
FIG. 11 is a view taken along line 11—11 of FIG. 8.
Figure 12:
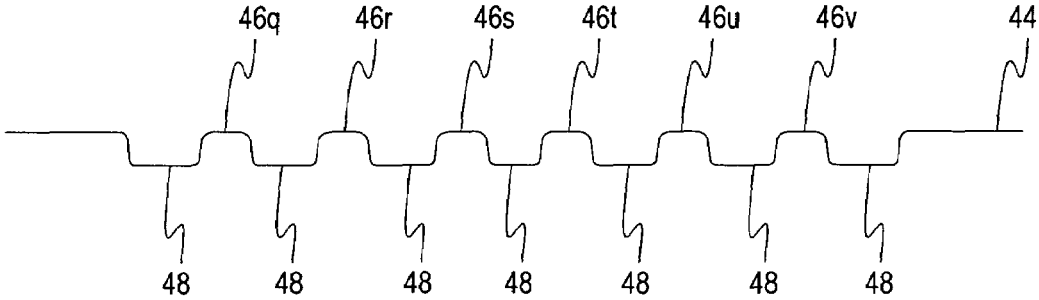
FIG. 12 is a view taken along line 12—12 of FIG. 8.
Figure 13:
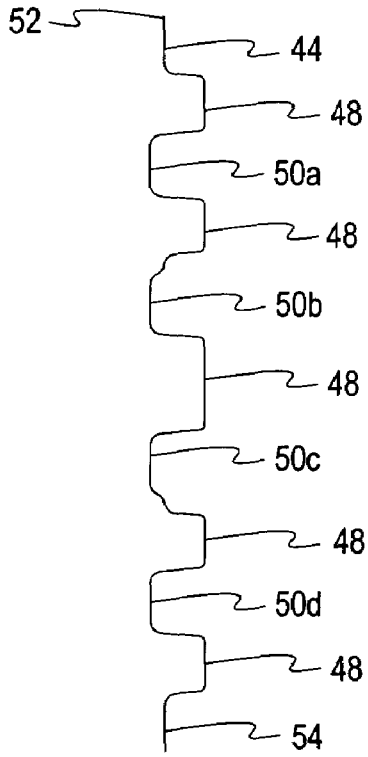
FIG. 13 is a view taken along line 13—13 of FIG. 8.
Figure 14:
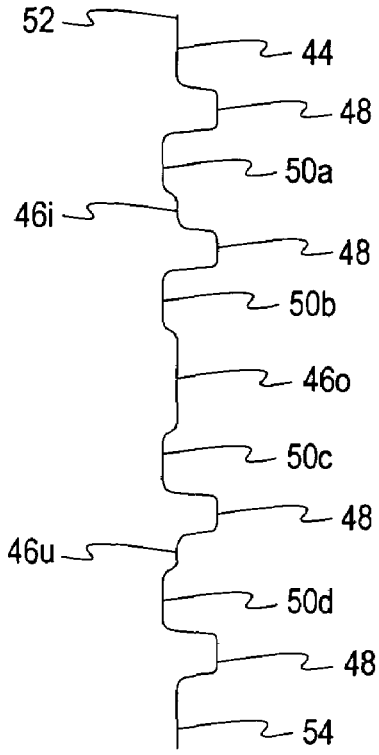
FIG. 14 is a view taken along line 14—14 of FIG. 7.

The first rib unit 22 also strengthens the side wall 18 against bending by providing multiple angles. The first female rib 24 is at an angle A to a vertical line 32 that is perpendicular to the bottom 16 (FIG. 4). The angle of the first male rib 26 to the vertical line 32 is B. The range for the angle A is from about 5° to about 44° and the range for the angle B is from about 6° to about 45°. Although the angles A and B can be equal, in a preferred embodiment the angle B is larger than angle A. The different angles A and B add to the strengthening effect of the first rib unit 22 and contribute to avoiding a straight line of bending in the base 10. The first rib unit 22 can be repeated around the entire side wall 18 to form a pattern or array. The array or pattern can be the first rib unit 22 positioned adjacent to each other or spaced apart with portions of the side wall 18 between rib units 22.

Additional depths and angles can be provided in the side wall 18 by a second rib unit 34 thermoformed in the side wall 18. The second rib unit 34 includes a second male rib 36. The second male rib 36 is shorter than the first male rib 26 and does not extend as far toward the rim 20 or into the bottom 16 as the first male rib 26. To provide additional angles the side wall 18 is at an angle C to the vertical line 32 (FIG. 4). Angle C is from about 5° to about 44°. The second male rib 36 is at an angle D to the vertical line 32 which is from about 6° to about 45°. Although the angle D of the second male rib can be at any angle in the range mentioned, it is preferred that the angle D of the second male rib 36 be different than the angle B of the first male rib 26. In addition, the depth X (FIG. 5) of the second male rib 36 is greater than the depth Y of the first male rib 26 contributing to the multiple depth characteristic of a rib array or pattern that includes both the first rib unit 22 and the second rib unit 34. A multiple angle, multiple depth rib array or pattern may include alternating the first rib unit 22 and the second rib unit 34 or may include any combination of multiple first rib units 22 interspaced by one or several second rib units 34.

To provide additional depths and angles to the array or pattern of ribs in the side wall a third rib unit 38 may be thermoformed into the side wall 18. The third rib unit 38 includes a second female rib 40 and a third male rib 42 formed in the female rib 40. The angle of the second female rib 40 to a vertical line 32 can be in the range from about 5° to about 44° and the angle of the third male rib 42 to a vertical line is in the range of from about 6° to about 45°. Although the angle of the second female rib 40 and the third male rib 42 can be the same, it is preferred that the angle of the third male rib 42 be greater than the angle of the second female rib 40.

The third rib unit 38 strengthens the side wall 18 against bending by providing multiple depths. The rounded surfaces or knuckles 30 (FIG. 3) formed between the third male rib 42 and the second female rib 40 results from the different widths of the third male rib 42 and the second female rib 40.

The second female rib 40 extends upwardly higher toward the rim 20 than does the third male rib 42. The first female rib 24 and the second female rib 40 are at the same height relative to the rim 20 as are the first male rib 26 and the third male rib 42. The second male rib 36 is shorter than the first male rib 26 and the third male rib 42. The second female rib 40 extends into the bottom 16 farther than the third male rib 42 but not as far as the first female rib 24. The third male rib 42 extends into the bottom 16 farther than the second male rib 36 but not as far as the first male rib 26. These different multiple extensions into the bottom 16 and the multiple heights relative to the rim 20 also add strength to the base 10 by preventing a straight bend line in the base 10.

Turning now to FIGS. 7–13, the bottom 16 of the base 10 is shown in more detail. The bottom 16 includes four different levels and alternating patterns of ribs perpendicular to the X and Y axis of the bottom 16 and angled relative to the X and Y axis. The pattern or array of alternating levels and angles prevents bending of the bottom 16 along the X or Y axis. The bottom 16 with its pattern or array of ribs combined with the side wall 18 with its pattern or array of ribs provides an increase in strength of the base 10 when supported or held at the first end 12 or second end 14 or at the corners while a force is loaded at the end opposite the end being held.

The bottom 16 includes a bottom wall 44 which defines one of four different levels or heights in the bottom 16. A second level or height is defined by a plurality of first or shallow ribs 46A–46Z formed in the bottom 16. A third level is provided by a plurality of depressions 48 formed in the bottom wall 44 and between the first or shallow ribs 46. A fourth level is defined by second or higher ribs 50A–50D. The four different levels as defined by the bottom wall 44, first, shallow ribs 46A–46Z, depressions 48, and second, higher ribs 50A–50D are alternated such that a straight line from a first side 52 of the bottom 16 to a second side 54 will pass through alternating levels as opposed to only one level.

In addition to alternating levels or elevations, the bottom 16 also has ribs at alternating angles. The second or higher ribs 50A–50D are horizontal and extend along the longitudinal axis of the bottom wall 44. These ribs 50A–50D also define beams extending along the length of the bottom wall 44 to provide beam strength to the bottom 16 of the base 10. Some of the first or shallow ribs 46K–46P are perpendicular to the second or higher ribs 50B and 50C while a first set of the first shallow ribs 46C–46G, 46T–46X are on an angle greater than about 0° and less than about 90° to the second higher ribs 50A–50D and a second set of first shallow ribs 46A, 46B, 46H–46J, 46Q–46S, 46Y and 46Z are at an angle (i.e., greater than about 180° and less than about 270°) opposite the angle of the first set of first shallow ribs. These alternating angles of the ribs are formed such that a straight line extending through the bottom 16 from the first side 52 to the second side 54 intersects alternating angles. The alternating levels and angles inhibit bending of the base 10 along a straight line when the base 10 is held at the first end 12 or second end 14 while a load is in the base 10 thereby providing strength to the base 10 in addition to the increased strength provided by the array or pattern of ribs in the side wall 18.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A base for a food container, comprising:

a bottom having a periphery; and a side wall upwardly extending around the periphery of the bottom, the side wall defining an interior of the base, the side wall including a plurality of first rib units formed in the side wall upwardly extending from the bottom, each of the plurality of first rib units including a first outward projecting rib extending away from the interior and a first inward projecting rib extending towards the interior, the first inward projecting rib being shorter than the first outward projecting rib, the first inward projecting rib being narrower than the first outward projecting rib; and a plurality of second rib units formed in the side wall upwardly extending from the bottom, at least one of the plurality of second rib units being disposed adjacent one of the plurality of first rib units, each of the plurality of second rib units including a second inward projecting rib extending towards the interior, the second inward projecting rib being shorter than the first inward projecting rib.

2. The base of claim 1 wherein the first inward projecting rib is formed within the first outward projecting rib.

3. The base of claim 1 wherein the first outward projecting rib extends into the bottom.

4. The base of claim 1 wherein the first inward projecting rib extends into the bottom.

5. The base of claim 1 wherein the first outward projecting rib is disposed at a first angle relative to a vertical axis and the first inward projecting rib is disposed at a second angle relative to the vertical axis, the first angle and the second angle being unequal.

6. The base of claim 5 wherein the second angle is greater than the first angle.

7. The base of claim 1 wherein the first outward extending rib is at a first depth in the side wall and the first inward extending rib is at a second depth in the side wall, said first depth is different than said second depth.

8. The base of claim 1 wherein the outward projecting rib extends into the bottom a first distance and the first inward projecting rib extends into the bottom a second distance, the first distance being greater than the second distance.

9. The base of claim 1 wherein the first outward projecting rib and the first inward projecting rib extend into the bottom, the depth of the first inward projecting rib extending into the bottom being greater than the depth of the first outward projecting rib extending into the bottom.

10. The base of claim 1 wherein the first outward projecting rib extends to a first height in the side wall and the first inward projecting rib extends to a second height in the side wall, the first height exceeding the second height.

11. The base of claim 1 wherein the side wall is disposed at an angle ranging from about 50 to about 44° relative to a vertical axis.

12. The base of claim 1 wherein the first inward projecting rib is disposed at a first angle relative to a vertical axis and second inward projecting rib is disposed at second angle relative to the vertical axis, the first angle being different than the second angle.

13. The base of claim 1 further comprising a plurality of third rib units formed in the side wall upwardly extending from the bottom, each of the plurality of third rib units being positioned adjacent one of the plurality of second rib units, each of the plurality of third rib units including a second outward projecting rib extending away from the interior and a third inward projecting rib extending towards the interior, the second outward projecting rib being shorter than the first outward projecting rib.

14. The base of claim 13 wherein the third inward projecting rib is formed within the second outward projecting rib.

15. The base of claim 13 wherein the second outward projecting rib extends into the bottom.

16. The base of claim 13 wherein the third inward projecting rib extends into the bottom.

17. The base of claim 13 wherein the second outward projecting rib is disposed at an first angle relative to a vertical axis and the third inward projecting rib is disposed at a second angle relative to the vertical axis, the first angle being unequal to the second angle.

18. The base of claim 17 wherein the second angle is greater than the first angle.

19. The base of claim 13 wherein the second outward projecting rib is disposed at third depth in the side wall and the third inward projecting rib is disposed at a fourth depth in the side wall, the third depth being different than the fourth depth.

20. The base of claim 13 wherein the second outward projecting rib and the third inward projecting rib extend into the bottom, the second outward projecting rib extending into the bottom farther than the third inward projecting rib.

21. The base of claim 20 wherein the height of the third inward projecting rib in the bottom is greater than the height of the second outward projecting rib in the bottom.

22. The base of claim 13 wherein the second outward projecting rib extends a first vertical distance up the side wall and the third inward projecting rib extends a second vertical distance up the side wall, the first vertical distance being greater than the second vertical distance.

23. The base of claim 1 wherein the second inward projecting rib extends into the bottom.

24. The base of claim 1 wherein the first and second inward projecting ribs extend into the bottom, the first inward projecting rib extending further into the bottom than the second inward projecting rib.

* * * * *